US006264503B1

(12) United States Patent
Emery

(10) Patent No.: US 6,264,503 B1
(45) **Date of Patent: *Jul. 24, 2001**

(54) COAXIAL CABLE CONNECTOR

(75) Inventor: William M. Emery, Swanton, OH (US)

(73) Assignee: Procom Manufacturing Co., Inc., Grand Rapids, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/451,524

(22) Filed: Nov. 30, 1999

Related U.S. Application Data

(63) Continuation-in-part of application No. 09/408,860, filed on Sep. 30, 1999, now Pat. No. 6,095,858.
(60) Provisional application No. 60/102,466, filed on Sep. 30, 1998.

(51) Int. Cl.[7] ..... H01R 9/05
(52) U.S. Cl. ..... 439/578
(58) Field of Search ..... 439/578, 583, 439/584

(56) References Cited

U.S. PATENT DOCUMENTS

| | | | | |
|---|---|---|---|---|
| 3,001,169 | | 9/1961 | Blonder . | |
| 4,097,867 | | 6/1978 | Eroncig . | |
| 4,101,898 | | 7/1978 | Ingram . | |
| 4,137,534 | | 1/1979 | Goodnight . | |
| 4,163,981 | | 8/1979 | Wilson . | |
| 4,214,247 | | 7/1980 | Richmond . | |
| 4,231,629 | * | 11/1980 | Kirby | 439/67 |
| 4,379,298 | | 4/1983 | Vincent et al. . | |
| 5,451,968 | | 9/1995 | Emery . | |
| 5,580,277 | | 12/1996 | Emery . | |
| 6,095,858 | * | 8/2000 | Emery | 439/578 |

* cited by examiner

*Primary Examiner*—Renee Luebke
*Assistant Examiner*—Briggitte R. Hammond
(74) *Attorney, Agent, or Firm*—Emch, Schaffer, Schaub & Porcello, Co., L.P.A.

(57) ABSTRACT

A coaxial cable for connecting a coaxial transmission line cable to an antenna which provides a rugged construction and provides a seal from moisture.

10 Claims, 2 Drawing Sheets

COAXIAL CABLE CONNECTOR

RELATED APPLICATIONS

This is a continuation-in-part of U.S. patent application Ser. No. 9/408,860 filed Sep. 30, 1999, now U.S. Pat. No. 6,095,858. This application claim benefit to provisional application 60/102,466 filed Sep. 30, 1998.

TECHNICAL FIELD

This invention relates to a new rugged cable connector means for connecting transmission line cables to antennas and, in particular, to a unitary connector means which can be inexpensively manufactured, and yet reduce radio frequency losses through the connections.

BACKGROUND OF THE INVENTION

In the industry of radio frequency equipment, antennas are connected to transmission line cables by connectors known as SO-239 and PL-259 screw machine connectors. These screw machine connectors are expensive to produce and are difficult to assemble. Additionally, the interconnecting male - female components are subject to radio frequency losses due to corrosion in harsh environments. One early type of transmission line connection described in the Blonder U.S. Pat. No. 3,001,169 patent was comprised of many small components which had to be individually assembled and which increased the points of contact at which corrosion or radio frequency disturbances could occur. Another attempt to prevent corrosion includes the Emery U.S. Pat. No. 5,580,277, which is an earlier invention by the present inventor, which describes embedding a contact plate in a plastic body to seal the cable connections to the contact plate and a machine screw which also isolates the contact plate from the atmosphere when attached to an antenna.

SUMMARY OF THE INVENTION

The present invention generally comprises a coaxial cable connector comprising a plurality of components. An internally threaded shell body receives a plastic stepped washer inserted through one end of the shell body. The plastic stepped washer matingly engages a distal end of the threaded shell body. An extended externally threaded member having a coaxial opening is positioned in the threaded shell body. A first end of the extended threaded member passes through an opening in the plastic stepped washer and matingly engages the stepped washer. The extended threaded member does not come into contact with the threaded shell body. An insulating flat washer which conforms to the interior diameter of the threaded opening of the shell body is positioned adjacent a second end of the extended threaded member. The flat washer acts as an insulator and as a mechanical seal. The flat washer defines an axial opening extending therethrough.

A tubular threaded conductor body having an axially extending opening is positioned in the threaded body. The opening of the tubular threaded body is internally threaded and has a first end which receives an internal washer. The tubular threaded body has at least one, and preferably a plurality of, radially extending soldering windows coaxially positioned in the shell body. It is to be understood that the soldering of any coaxial cable wire extending through the tubular threaded conductor body is accomplished prior to the coaxial insertion of the tubular threaded conductor body into the opening defined in the threaded shell body. At least an internal wire of the coaxial cable extends through the coaxial openings in the internal washer of the tubular threaded conductor body, the flat washer, the threaded shell body, the stepped washer and the extended threaded member.

A tubular threaded strain relief member is coaxially positioned on the coaxial cable prior to the coaxial cable being inserted through the coaxial cable connector. The tubular threaded strain relief member can be threaded to the tubular threaded conductor body to provide both compression and connection of the outer wires of the coaxial cable to the tubular threaded body.

One object of the present invention is to produce a coaxial cable connector which is not susceptible to corrosion damage due to incomplete or leaky seals between the components of the connector.

Another object of this invention is to reduce the number of component parts by producing a single unitary connector, thereby reducing manufacturing costs and reducing the assembly time. Additionally, another object of this invention is to reduce radio frequency losses that typically occur between components of a cable connector by producing a unitary connector.

Other objects and advantages of the present invention will become apparent to those skilled in the art upon a review of the following detailed description of the preferred embodiments and the accompanying drawings.

DETAILED DESCRIPTION OF THE PREFERRED EMBODIMENT

Figure 1:
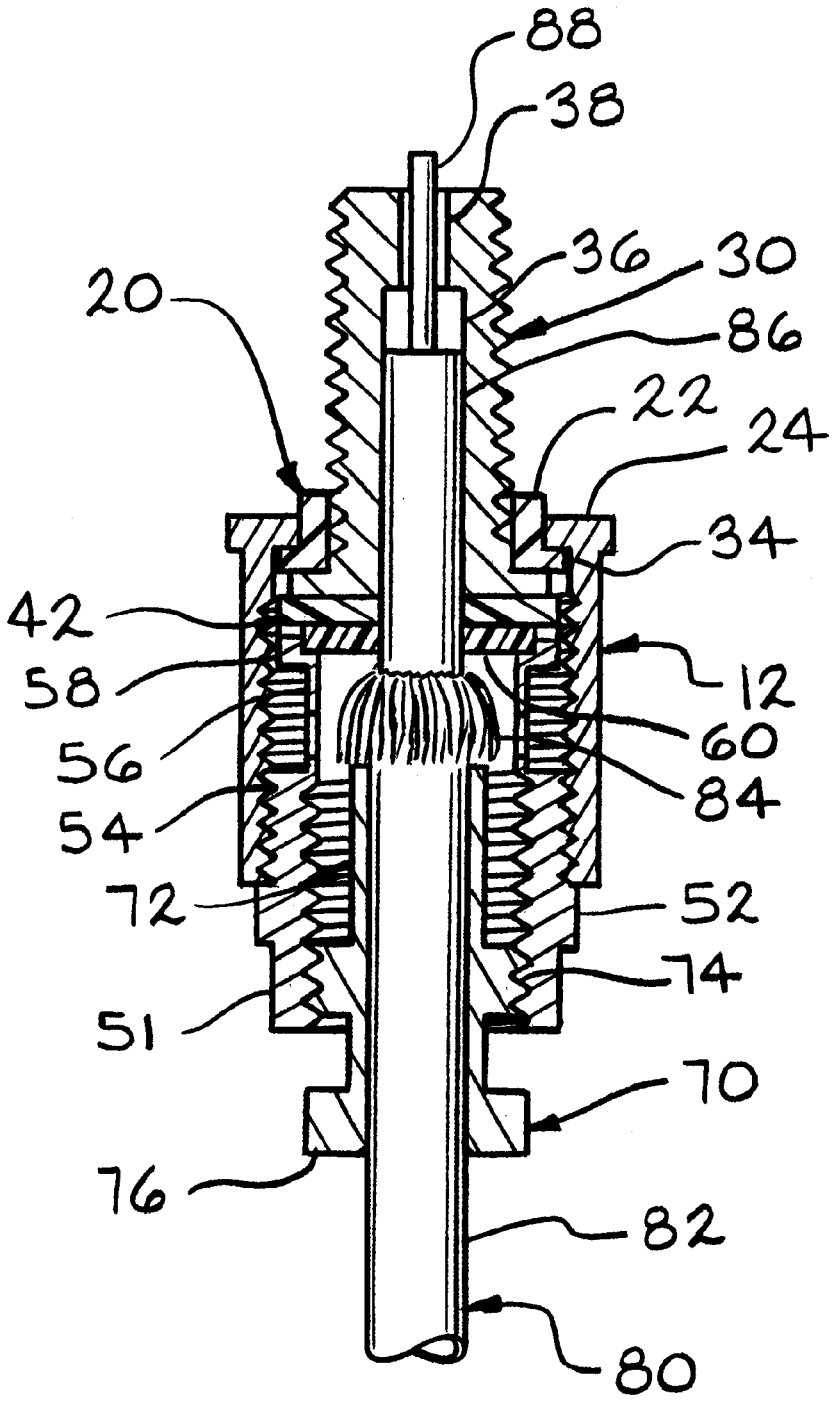
FIG. 1 is a cross-sectional view of a coaxial cable connector.
Figure 2:
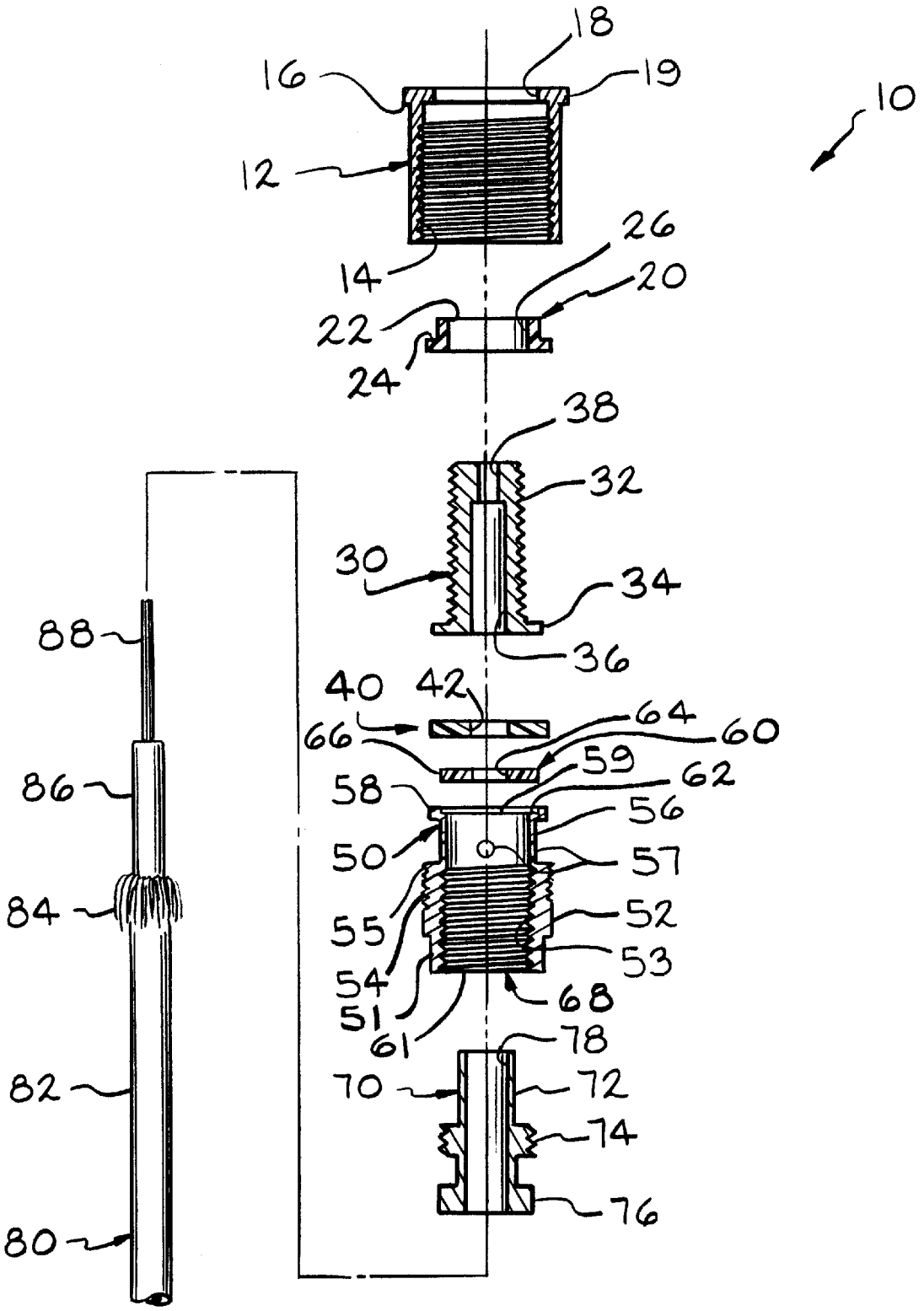
FIG. 2 is an exploded view partially cross-sectional view of the components comprising a coaxial cable connector.

A coaxial connector 10 comprises a hexagonly headed shell body 12 which has an internal threaded passageway 14. The threaded shell body 12 defines a inner shoulder or flange 16. The threaded shell body 12 has an axial extending opening 18 adjacent the shoulder 16 which extends through a hexagon head portion 19. The opening 18 is in communication with the internal threaded passageway 14. The outer shell body protects the coaxial connector from a harsh external environment and also acts as an electrical ground.

An insulating step washer 20 having a neck 22 and a shoulder 24 is positioned in the shell body 12. The step washer 20 defines a coaxial opening 26. The step washer 20 is matingly positioned within the threaded passageway 14 of the shell body 12 such that the shoulder 24 of the step washer 20 matingly engages the shoulder 16 of the shell body 12. The neck 22 of the washer 20 extends through the opening 18 of the threaded shell body 12. The neck 22 of the step washer 20 can extend beyond a planar surface of the hexagonal head portion 19.

An extended threaded member 30 has an exterior threaded shank 32 and a flange 34 that extends from one end of the threaded shank 32.

The flange 34 has an external diameter which is less than an internal diameter defined by the threaded passageway 14 of the shell body 12.

The extended threaded member 30 defines a first coaxial opening 36 which extends from the shoulder 34 part way into the interior of the extended threaded member 30. The first coaxial opening 36 has a first diameter. The first coaxial opening 36 is in communication with a second coaxial opening 38 which starts at the end of the extended threaded member 30 and extends into the interior of the extended threaded member 30. The second coaxial opening 38 has a second diameter that is smaller than the diameter of the first coaxial opening 36.

The shank 32 of the extended threaded member 30 is coaxially positioned within the opening 26 of the step washer 20 such that the threaded shank 32 generally extends in a direction away from the hexagon head portion 19 of the threaded shell body 12. The step washer 20 provides insulation between the extended threaded member 30 and the outer shell body 12. A flat insulating washer 40 having a coaxial opening 42 extending therethrough is coaxially positioned within the threaded shell body 12. The opening 42 of the flat washer 40 can have the same diameter as the first coaxial opening 36 of the extended threaded member 30.

An outer tubular conductor body 50 has a tubular section 52 having an internal threaded region 53 and an external threaded fitting section 54. The external threaded fitting section 54 has a diameter that is substantially the same as the diameter of the tubular section 52. The tubular section 52 defines at least two opposed sides 51 which preferably are in a parallel relationship. The sides 51 are adjacent a first end 61 of the conductor body 50. The sides 51 readily allow the conductor body 50 to be tightened into the threaded passageway 14 of the shell body 12. A plurality of threads 55 are positioned on the outer perimeter of the threaded fitting section 54. The conductor body 50 further has a cylindrical body 56 which extends from the threaded fitting section 54 in a direction away from the tubular section 52. The cylindrical body 56 defines at least one, and preferably a plurality, of radially extending windows or openings 57. The openings 57 are positioned in a radially spaced relationship around the cylindrical body 56 and extend through the cylindrical body 56. The conductor body 50 further has a positioning flange 58 that is spaced apart from threaded fitting section 54 and the first end 61. The positioning flange 58 defines a coaxial opening 59 having a shoulder 62. An insulating interior washer 60 is coaxially positioned adjacent the shoulder 62 which defines the opening 59. The insulating interior washer 60 defines an axially extending opening 64. The positioning flange 58 can have a plurality of external axially extending ridges 66 on the external circumference of the positioning flange 58.

A channel 68 extends axially through the outer conductor body 50. The channel 68 is defined by the internal threaded region 53 in the tubular section 52. The channel 68 terminates at the opening 64 in the insulating washer 60 which is in the opening 59 in the positioning flange 58. It is to be noted that the flat washer 40 also provides insulation between the extended threaded member 30 and an outer conductor body 50.

Before assembly, a coaxial wire 80 is at least partially stripped of insulation and inserted through the opening 64 in the insulating washer 60 in the outer conductor body 50. The wire 80 has external insulation 82, external wires 84 positioned under the external insulation 82, inner insulation 86 positioned under the external wires 84, and internal wires 88 positioned in the middle of the internal insulation 86.

The internal wires 88 extend through the first coaxial opening 36 of the extended threaded member 30. The inner insulation 84 of the wire 80 generally terminates adjacent the second coaxial opening 38 of the extended threaded member 30.

The external wires 84 are exposed and can be soldered to the outer conductor body 50 through the openings or windows 57 of the outer conductor body 50.

The outer conductor body 50 is coaxially positioned in the shell body 12 such that the positioning flange 58 of the conductor body 50 comes into mating engagement with the flat washer 40 as the threads 55 on the threaded fitting section 54 engage the threaded passageway 14 of the shell body 12.

The coaxial cable connector 10 can further include a strain relief member 70 which has a tubular member 72. and a bolt head 76 positioned on one end of the tubular member 72. A coaxial opening 78 extends through the tubular member 72 and the bolt head 76. External threads 74 are positioned on the tubular member 72 adjacent the bolt head 76. The strain relief member 70 is positioned on the wire 80 prior to the soldering of the exterior wires 84 to the outer conductor body 50.

The external threads 74 matingly engage the threaded region 53 of the tubular section 52 of the outer conductor body 50. The tubular member 72 contacts the external wires 84 and compresses the wires 84 against the cylindrical body 56 of the outer conductor body 50 to aid in making a good electrical connection.

The tubular threaded strain relief member 70 provides a compression fit of the external wires 84 against the outer conductor body 50. In addition, the tubular threaded strain relief member 70 provides strain relief between the outer conductor body 50 and the coaxial transmission wire 80.

As the various portions of the coaxial cable connector are threaded together, the individual components are compressed to ensure strength as well as to provide a seal from moisture.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

I claim:

1. A coaxial cable connector comprising:

an internally threaded shell body having a coaxial opening extending therethrough;

an insulating stepped washer having a neck and a shoulder and a coaxial opening extending therethrough, the stepped washer being coaxially positioned in the threaded shell body whereby the neck extends through the coaxial opening of the shell body;

an externally threaded extended member having an exterior threaded shank and a flange and a coaxial opening extending therethrough, the extended member being coaxially positioned in the threaded shell body whereby at least a portion of the shank extends through the coaxial opening in the stepped washer and whereby one side of the flange of the threaded extended member is adjacent the shoulder of the stepped washer;

an insulating flat washer having a coaxial opening therethrough, the flat washer being coaxially positioned in the threaded shell body whereby the flat washer is positioned adjacent an opposing side of the flange of the threaded extended member; and, an outer conductor body having a internally threaded tubular section which terminates at an externally threaded section, a cylindrical body which extends from the external threaded fitting of the tubular section, and a positioning flange which extends from an end of the cylindrical body that is spaced apart from the tubular section, the outer conductor body having a coaxial opening therethrough;

the external threaded fitting section having a diameter that is substantially the same as a diameter of the tubular section;

the cylindrical body having at least one radially extending opening therethrough, the radially extending opening being in communication with the coaxial opening in the conductor body;

an internal insulating washer having a coaxial opening therethrough, the internal insulating washer being positioned in the coaxial opening in the positioning flange;

the outer conductor body being coaxially positioned in the threaded shell body whereby the positioning flange of the outer conductor body is adjacent the flat washer.

2. The connector of claim 1, wherein the threaded shell body is an electrical ground.

3. The connector of claim 1, wherein the flat washer is a compression member of the coaxial cable connector.

4. The connector of claim 1, wherein the flat washer is a mechanical moisture seal.

5. The connector of claim 1, wherein a tubular threaded strain relief member is threadingly engaged within the internally threaded tubular section of the outer conductor body.

6. The connector of claim 1, wherein the threaded shell body is a shield from an external environment.

7. The connector of claim 1, wherein the cylindrical body has at least 2 radially extending openings.

8. The connector of claim 1, wherein -the cylindrical body has at least 4 radially extending openings.

9. The connector of claim 1, wherein the tubular section of the conductor body has at least 2 opposed sides adjacent a first end of the tubular section.

10. The connector of claim 1, wherein the positioning flange has a plurality of axially extending ridges on an external circumference of the positioning flange.

* * * * *